US005443751A

United States Patent [19]

Mazzola

[11] Patent Number: 5,443,751

[45] Date of Patent: Aug. 22, 1995

[54] POWDER DETERGENT COMPOSITION FOR COLD WATER WASHING OF FABRICS

[75] Inventor: Louis R. Mazzola, Mahwah, N.J.

[73] Assignee: Church & Dwight Co. Inc., Princeton, N.J.

[21] Appl. No.: 241,460

[22] Filed: May 11, 1994

Related U.S. Application Data

[63] Continuation of Ser. No. 27,198, Mar. 5, 1993, abandoned.

[51] Int. Cl.[6] ..... C11D 17/06; C11D 3/10; C11D 9/12; C11D 11/00

[52] U.S. Cl. ..... 252/174.13; 252/89.1; 252/108; 252/109; 252/121; 252/132; 252/133; 252/174; 252/174.14; 252/174.21; 252/531; 252/534; 252/539; 252/540; 252/550; 252/553; 252/558; 252/559

[58] Field of Search ..... 252/109, 121, 133, 135, 252/530, 531, 534, 539, 540, 553, 556, 559, 174.13, 174.14, 174.31, 174.32, DIG. 1, 89.1, 108, 174, 550, 558

[56] References Cited

U.S. PATENT DOCUMENTS

| | | | |
|---|---|---|---|
| 3,868,336 | 2/1975 | Mazzola et al. | 252/135 |
| 4,196,095 | 4/1980 | Cala et al. | 252/140 |
| 4,530,774 | 7/1985 | Davies et al. | 252/108 |
| 4,695,284 | 9/1987 | Hight | 8/137 |

*Primary Examiner*—Paul Lieberman
*Assistant Examiner*—M. Kopec
*Attorney, Agent, or Firm*—Charles B. Barris

[57] ABSTRACT

This invention provides a sodium carbonate-based laundry detergent powder which can be utilized in cold water fabric laundering with a minimized remainder of undissolved detergent residue in the wash water. A water-soluble fatty acid salt such as sodium stearate is incorporated as an adherent coating on the detergent granules, in a quantity which is effective for reducing the residue of undissolved sodium carbonate under cold water laundering conditions.

9 Claims, 3 Drawing Sheets

POWDER DETERGENT COMPOSITION FOR COLD WATER WASHING OF FABRICS

CROSS-REFERENCE TO RELATED PATENT APPLICATION

This application is a continuation of application Ser. No. 08/027,198, filed Mar. 5, 1993, now abandoned.

BACKGROUND OF THE INVENTION

Heavy duty powder detergent compositions for home use fabric laundering generally perform well and are widely accepted. With the increasing trend to cold water washing of fabrics at wash water temperatures below about 60° F. for energy conservation, commercial laundry detergent compositions tend to leave a cold water residue (CWR) of undissolved detergent solids after completion of the wash machine cycles.

The detergency of powder detergent compositions in fabric laundering applications is directly affected by the hardness of the wash water. Control of water hardness typically is achieved with detergency builders, such as water-soluble sequestering builders, water-insoluble ion exchange builders, and water-soluble precipitating builders.

Sodium carbonate is a preferred detergent builder because of cost considerations, but it has inherent disadvantages. Sodium carbonate alone is not capable of reducing the calcium ion concentration in hard water to a level sufficient to provide high detergency under conventional fabric washing conditions. Also, precipitated calcium carbonate tends to coat undissolved detergent particles.

Particularly in the case of cold water laundering of fabrics, the coating of detergent particles with precipitated calcium carbonate suppresses dissolution of the sodium carbonate ingredient. This results in a substantial loss of detergency building activity, and there is a consequential remainder of a cold water residue of undissolved detergent solids.

Laundry detergent formulations which have been developed for use in cold water washing of fabrics are described in U.S. Pat. Nos. 4,196,095; 4,530,774; and 4,695,284.

There is continuing interest in the development of heavy duty laundry detergents which exhibit improved properties for cold water laundry applications.

Accordingly, it is an object of this invention to provide a powder detergent composition which performs with a minimized amount of residual undissolved detergent solids under cold water fabric laundering conditions.

It is a further object of this invention to provide a process for producing a powder detergent composition which has detergent granules coated with a fatty acid salt ingredient.

Other objects and advantages of the present invention shall become apparent from the accompanying description and examples.

DESCRIPTION OF THE INVENTION

One or more objects of the present invention are accomplished by the provision of a laundry detergent composition which is a granulated blend of ingredients comprising (a) between about 40–90 weight percent of a water-soluble inorganic salt detergent builder ingredient, wherein at least one third of the inorganic salt detergent builder ingredient is sodium carbonate; (b) between about 2–20 weight percent of an anionic detergent ingredient; (c) between about 2–20 weight percent of a nonionic detergent ingredient; and (d) between about 0–15 weight percent of alkali metal silicate; and wherein between about 0.7–5 weight percent of a particulate fatty acid salt ingredient selected from alkali metal and ammonium salts of stearic acid and oleic acid, having an average particle size between about 50–200 microns, is coated on the surfaces of the detergent granules.

Suitable water-soluble inorganic salt detergent builder compounds include alkali metal and ammonium carbonates, bicarbonates, sesquicarbonates, silicates, phosphates, orthophosphates, pyrophosphates, tripolyphosphates, silicates, borates, and the like. Sodium and potassium carbonates, bicarbonates, sesquicarbonates and tripolyphosphates are illustrative of preferred types of inorganic salt detergent builder compounds.

The term "water-soluble" as employed herein refers to a chemical compound which has a solubility of at least about 2 grams per 100 grams of water at 25° C.

Suitable anionic detergent active compounds include water-soluble alkali metal and ammonium salts of organic sulfates and sulfonates containing an alkyl radical of 8–22 carbon atoms. Illustrative of anionic compounds are sodium, potassium and ammonium salts of straight chain $C_{10}$–$C_{18}$ alkyl sulfates, $C_{10}$–$C_{18}$ alkyl ether sulfates and $C_{10}$–$C_{18}$ alkylbenzenesulfonates.

Suitable nonionic detergent active compounds include aliphatic alcohols, acids, amides and alkylphenols containing 8–30 carbon atoms, and additional alkylene oxide groups. Illustrative of preferred nonionic compounds are linear primary or secondary $C_{12}$–$C_{15}$ monohydric alcohols which are ethoxylated with 3–15 ethylene oxide units, and $C_8$–$C_{16}$ alkylphenols ethoxylated with 4–12 ethylene oxide units per molecule.

The particulate fatty acid salt ingredient is selected from sodium, potassium and ammonium salts of stearic acid and oleic acid, and typically has an average particle size between about 70–180 microns.

A present invention laundry detergent composition can contain other optional detergent adjuncts, which include lather boosters such as alkanolamines, lather depressants such as alkyl phosphates or silicones, anti-redeposition agents such as sodium carboxymethylcellulose, oxygen-releasing bleaching agents such as sodium perborate or sodium percarbonate, fabric softening agents, fluorescent agents, perfumes, enzymes, germicides, colorants, and the like.

A preferred type of anti-redeposition agent is sodium polyacrylate having a molecular weight of 10,000–50,000.

It is generally desirable to include a sodium or potassium silicate ingredient in the laundry detergent composition to provide buffering capacity and to prevent corrosion of metal parts in washing machines.

In another embodiment this invention provides a process for producing a powder detergent composition which comprises (1) forming a granulated blend of ingredients comprising (a) between about 40–90 weight percent of a water-soluble inorganic salt detergent builder ingredient, wherein at least one third of the inorganic salt detergent builder ingredient is sodium carbonate; (b) between about 2–20 weight percent of an anionic detergent ingredient; (c) between about 2–20 weight percent of a nonionic detergent ingredient; and (d) between about 0–15 weight percent of sodium silicate; and (2) dry mixing the detergent blend granules with between about 0.7–5 weight percent of a particulate fatty acid salt ingredient selected from alkali metal and ammonium salts of stearic acid and oleic acid having an average particle size between about 50–200 microns, thereby forming an adherent coating on the surfaces of the detergent blend granules.

The particulate builder and other main ingredients are blended in an initial procedure. The blend then is agglomerated in a rotating drum, inclined pan or paddle-type mixer with water spraying to form agglomerated detergent solids. The detergent granules preferably have a bulk density between about 700–1050 grams/liter.

The detergent granules then are dry blended with the fine fatty acid salt ingredient and other minor ingredients for a period of about 2–10 minutes or longer.

The final detergent composition consists of detergent blend granules which have an adherent coating of fine particles of fatty acid salt on the surfaces of the detergent blend granules.

The fatty acid salt coating has a direct effect on the quantity of cold water residue of detergent solids which remain undissolved when the powder detergent composition is employed for cold water fabric washing under home use conditions.

After a laundry load and detergent powder are placed in a home wash machine, the initial wash water normally is added to the wash machine contents over a period of about five minutes. The machine agitator is off during the initial wash water addition, thereby providing a relatively static medium around the detergent particles. This is a critical phase of the laundering operation with respect to the eventual quantity of cold water residue which remains undissolved.

With conventional laundry detergents, the water hardness causes a precipitate of calcium carbonate to form a water-insoluble coating on the surfaces of the detergent granules, which decreases dissolution of the sodium carbonate contained in the core of the calcium carbonate coated granules. This has the effect of limiting the detergency power of the detergent active ingredients, and increasing the quantity of cold water residue remaining after completion of the laundering cycles.

A present invention laundry detergent composition can be utilized in cold water fabric washing under home use conditions with little or no cold water residue remaining after completion of the laundering cycles. It appears that the fatty acid salt coating on the detergent granules functions as a barrier, and prevents the formation and deposition of calcium carbonate as a coating on detergent granule surfaces. As water molecules penetrate the fatty acid salt coating on the detergent granules, fatty acid calcium salt is formed in the fatty acid coating, and softened water passes through the fatty acid salt coating and dissolves the core sodium carbonate of the detergent granules.

The immediate effect is to establish and maintain an exclusive zone of softened water in contact with the detergent granule surfaces in the wash machine, during the initial wash water filling stage. This results in more rapid solvation of the detergent solids, an enhancement of detergency activity, and a reduction or elimination of any cold water residue of undissolved detergent solids.

The following examples are further illustrative of the present invention. The components and specific ingredients are presented as being typical, and various modifications can be derived in view of the foregoing disclosure within the scope of the invention.

EXAMPLE I

This Example illustrates reduction of cold water residue in fabric washing with a powder detergent composition in accordance with the present invention.

| Control Formulation | Parts By Weight |
|---|---|
| sodium carbonate | 81.9 |
| sodium Neodol 25-3 sulfate(1) | 4.3 |
| Neodol 25-3 | 2.4 |
| sodium sulfate | 1.5 |
| sodium bicarbonate | 1.3 |
| Acusol 912N(2) | 0.7 |
| sodium carboxymethylcellulose(3) | 0.1 |
| optical brightener | 0.2 |
| perfume | 0.1 |
| polyvinyl alcohol(4) | 0.1 |
| water | 7.4 |

| Invention Formulation | Parts By Weight |
|---|---|
| sodium carbonate | 81.9 |
| sodium Neodol 25-3 sulfate | 4.3 |
| Neodol 25-3 | 2.4 |
| sodium sulfate | 1.5 |
| sodium bicarbonate | 1.3 |
| polymer solids | 0.7 |
| sodium carboxymethylcellulose | 0.1 |
| optical brightener | 0.2 |
| perfume | 0.1 |
| polyvinyl alcohol | 0.1 |
| water | 7.4 |
| sodium stearate | 0.25–10 |

(1)Ethoxylated $C_{12}$–$C_{15}$ alcohol sulfate salt (Shell Chemical Company).
(2)Sodium polyacrylate; Rohm & Haas
(3)Finetex Inc.
(4)M.W. 15,000–30,000; Airco.

In preparing the formulations, the detergent ingredients, except the sodium stearate, are dry blended and agglomerated with sprayed water. The granules have an average diameter of 500 microns, and bulk density of 912 grams/liter. The sodium stearate (average particle size of 90–110 microns) is added as the last ingredient by dry blending for three minutes to form an adherent coating of sodium stearate on the detergent blend granules.

A standard Kenmore home use washing machine is employed for the comparative tests.

A 113 gram quantity of detergent formulations is placed in the washing machine. A five pound load of fabrics is added. The machine is run through wash and rinse cycles with a water temperature of 40° F. At the end of the spin cycle, any remaining detergent is retrieved and weighed.

Figure 1:
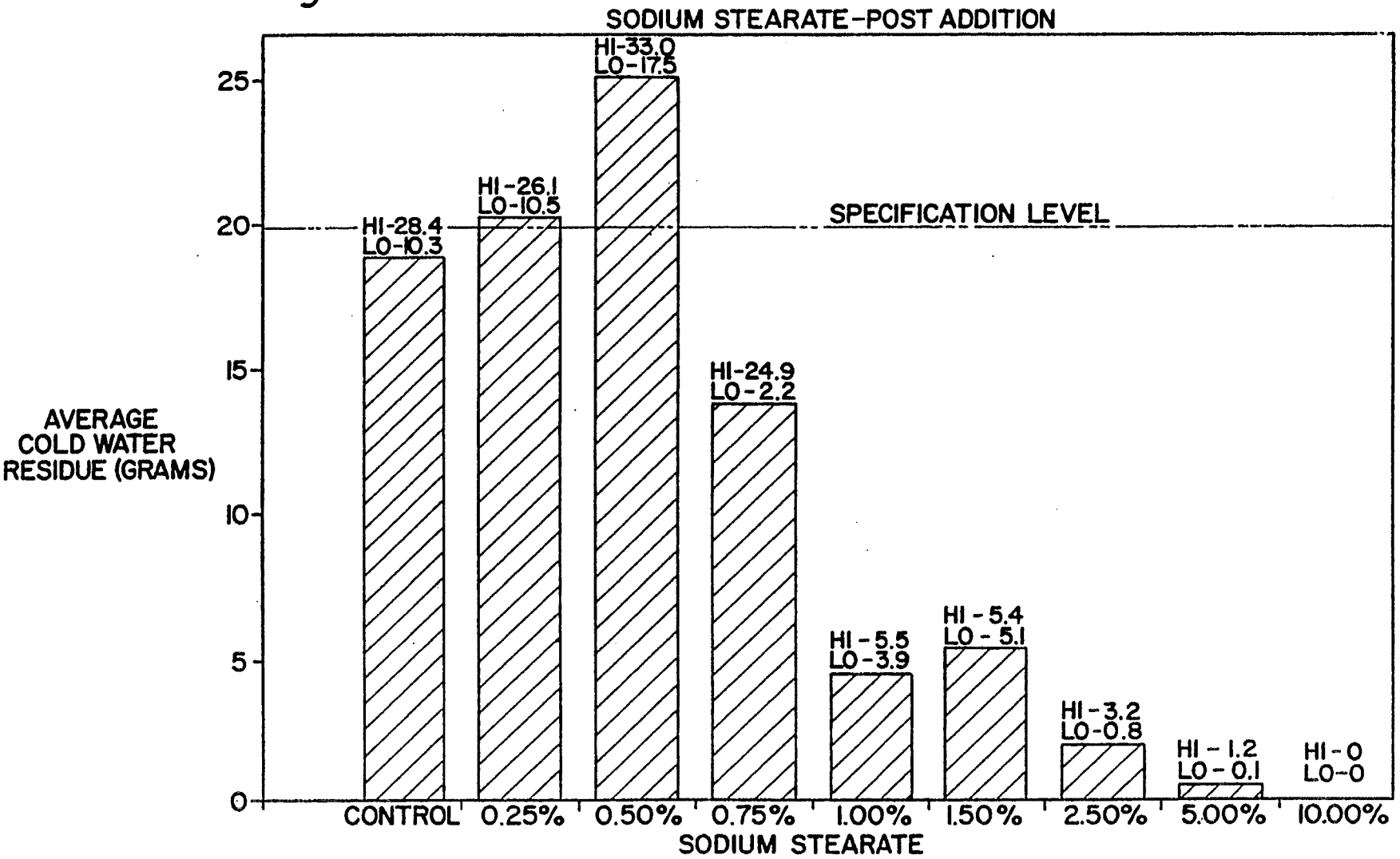
FIG. 1 is a graphic representation of average cold water residue of detergent solids which have a surface coating of varied concentrations of post-addition sodium stearate.

FIG. 1 is a summary of comparative results. The data for each formulation represent the average of several runs. The standard specification is indicated as 20 grams under the testing conditions.

The data demonstrate that an invention detergent formulation containing above about 0.7 weight percent of a surface-coating of sodium stearate is effective for reducing the cold water residue (CWR) of detergent solids under conventional home use fabric washing conditions using relatively cool water.

EXAMPLE II

This Example illustrates the superior results obtained when sodium stearate is utilized as a laundry detergent post-additive in comparison with calcium stearate for reduction of cold water residue under fabric washing conditions.

The procedures of Example I are followed for the preparation of detergent formulations, and for the testing of the formulations under cold water fabric laundering conditions.

In the formulations containing sodium stearate, calcium stearate or zeolite A (Valfore 100, PQ Corporation), the additive compound is added as a last ingredient With three minutes of dry blending to form an adherent coating of fine additive particles on the larger detergent blend granules.

Figure 2:
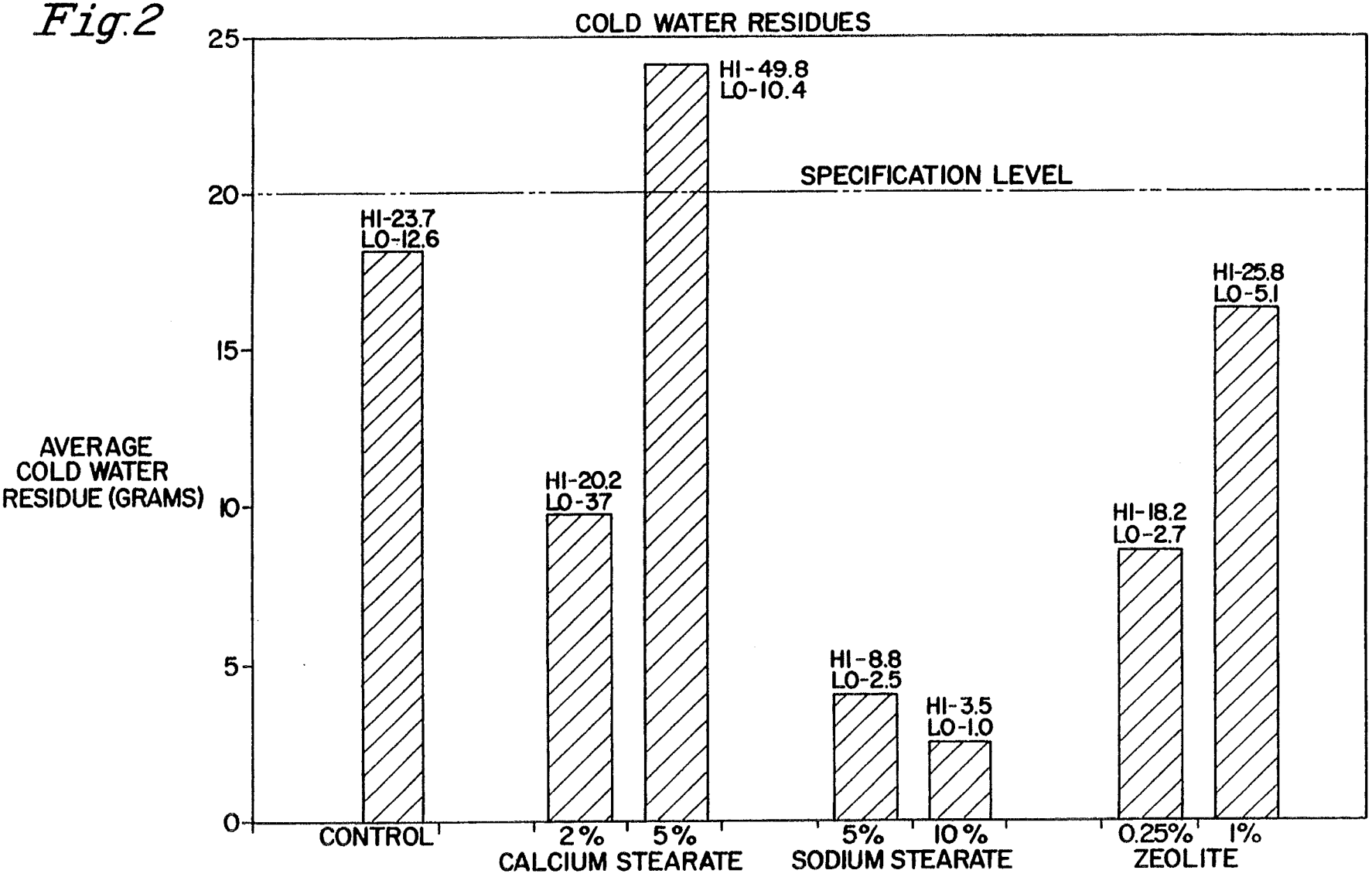
FIG. 2 is a graphic representation of average cold water residue of detergent solids which have a surface coating of a selected post-addition compound.

FIG. 2 is a summary of comparative results. The data demonstrate that sodium stearate is more effective than calcium stearate or zeolite A for reducing the cold water residue of detergent solids under fabric washing conditions.

EXAMPLE III

This Example illustrates the dissolution rate of an invention detergent composition in accordance with the present invention.

An invention detergent formulation similar to that described in Example I is tested for dissolution rate by measuring the conductivity of an aqueous solution containing the detergent.

The detergent solubility rate is measured with a conductance meter (YSI model 32 with ATP). A jacketed beaker (40° F.) is filled with two liters of tap water. A 3.54 gram quantity of detergent sample is added to the beaker medium, and the medium is stirred. A conductance probe (YSI model 3403) is employed to monitor the conductivity of the medium up to a maximum reading, and the conductivity is correlated with weight percent of dissolved detergent.

Figure 3:
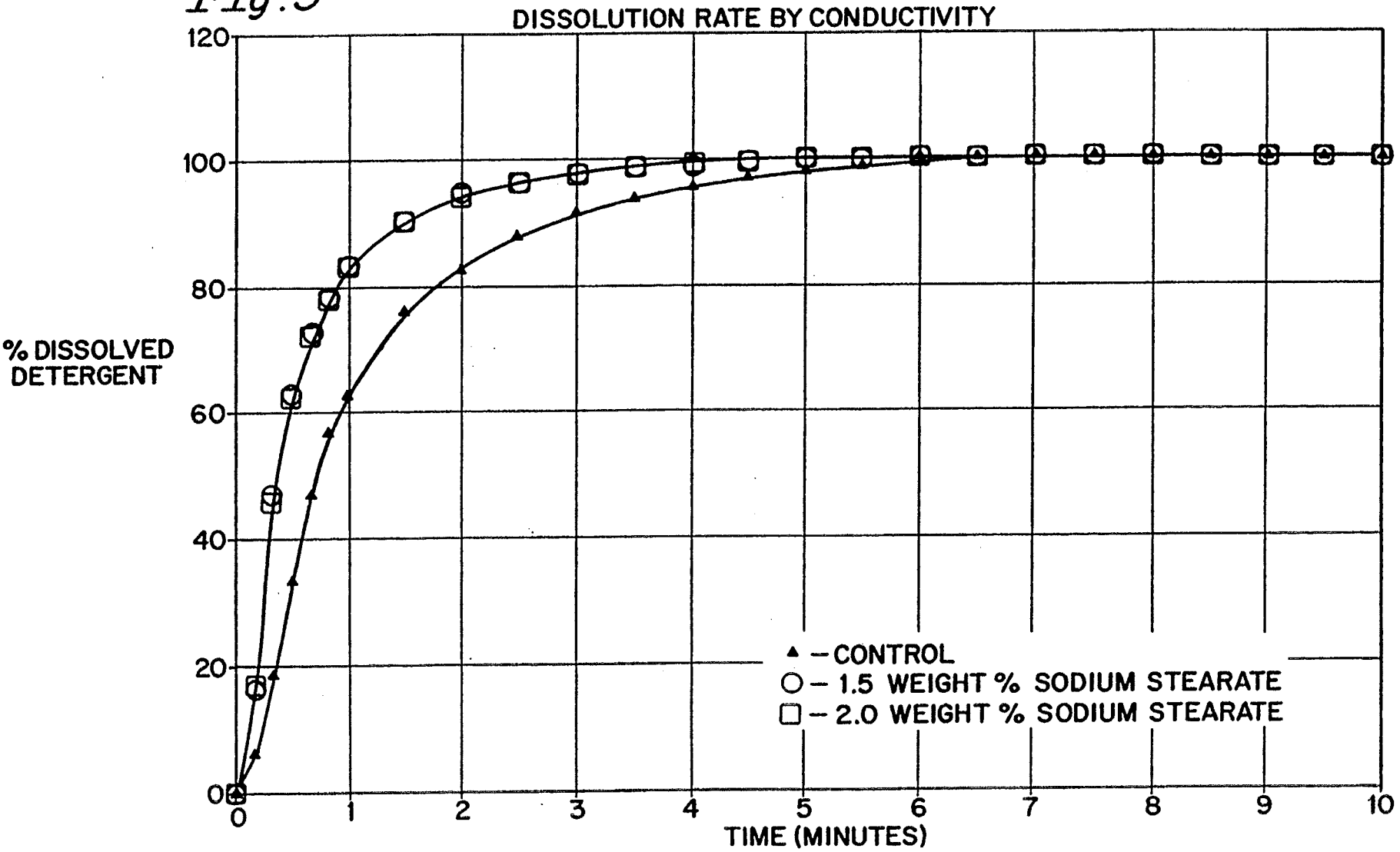
FIG. 3 is a graphic representation of detergent dissolution rate as determined by conductivity measurement of the aqueous medium. The graph illustrates a control detergent in comparison with a sodium stearate-coated detergent.

FIG. 3 is a graphic representation of the detergent dissolution rate by conductivity measurement.

EXAMPLE IV

This Example illustrates the reduction of cold water residue in fabric washing with a powder detergent composition in accordance with the present invention.

The following compositions are formulated and tested for cold water residue under fabric washing conditions.

| A. | Parts By Weight |
|---|---|
| Sodium Carbonate | 68.50 |
| Sodium Alkylbenzenesulfonate | 6.30 |
| Ethoxylated Alcohol | 7.40 |
| Sodium Silicate | 5.10 |
| Sodium Phosphate | 2.60 |
| Sodium Carboxymethylcellulose | 0.10 |
| Sodium Sulfate | 1.00 |

-continued

| A. | Parts By Weight |
|---|---|
| Water | 9.00 |

The granules have an average diameter of 609 microns, and a bulk density of 655 grams/liter. A cold water residue test indicates a residue weight of 15.5 grams.

When the same formulation has a 1.5 weight percent post-addition surface coating of sodium stearate, no cold water residue remains.

| B. | Parts By Weight |
|---|---|
| Sodium Carbonate | 80.30 |
| Sodium Sulfate | 1.00 |
| Sodium Phosphate | 2.20 |
| Sodium Silicate | 3.30 |
| Sodium Carboxymethylcellulose | 0.10 |
| Ethoxylated Alcohol | 5.00 |
| Water | 8.10 |

The granules have an average particle diameter of 515 microns, and a bulk density of 905 grams/liter. A cold water residue test indicates a residue weight of 27.5 grams.

When the same formulation has a 2.5 weight percent post-addition surface coating of sodium stearate, no cold water residue remains.

What is claimed is:

1. A laundry detergent composition which is a granulated blend of ingredients comprising (a) between about 40–90 weight percent of water-soluble inorganic salt detergent builder ingredient, wherein at least one third of the inorganic salt detergent builder ingredient is sodium carbonate; (b) between about 2–20 weight percent of an anionic detergent ingredient; and (c) between about 2–20 weight percent of a nonionic detergent ingredient; and wherein between about 0.7–5 weight percent of an ingredient consisting of particulate fatty acid salt selected from alkali metal and ammonium salts of stearic acid and oleic acid, having an average particle size between about 50–200 microns, is coated on the surfaces of the detergent granules.

2. A powder detergent composition in accordance with claim 1 wherein the inorganic salt ingredient comprises a mixture of sodium bicarbonate and sodium carbonate.

3. A powder detergent composition in accordance with claim 1 wherein the inorganic salt ingredient comprises a mixture of sodium sesquicarbonate and sodium carbonate.

4. A powder detergent composition in accordance with claim 1 wherein the inorganic salt ingredient comprises a mixture of sodium tripolyphosphate and sodium carbonate.

5. A powder detergent composition in accordance with claim 1 wherein the anionic detergent ingredient comprises sodium, potassium or ammonium salt of linear $C_{10}$–$C_{18}$ alkylbenzenesulfonate or any mixture thereof.

6. A powder detergent composition in accordance with claim 1 wherein the anionic detergent ingredient comprises sodium, potassium or ammonium dodecyl benzenesulfonate or any mixture thereof.

7. A powder detergent composition in accordance with claim 1 wherein the nonionic detergent ingredient comprises $C_{12}$–$C_{15}$ monohydric alcohol ethoxylated with 3–15 ethylene oxide units per molecule.

8. A powder detergent composition in accordance with claim 1 wherein the fatty acid salt ingredient is sodium, potassium or ammonium stearate or oleate or any mixture thereof, and wherein the fatty acid salt ingredient is a particulate solid having an average particle size between about 70–180 microns.

9. A process for producing a powder detergent composition which comprises (1) forming a granulated blend of ingredients comprising (a) between about 40–90 weight percent of a water-soluble inorganic salt detergent builder ingredient, wherein at least one third of the inorganic salt detergent builder ingredient is sodium carbonate, (b) between about 2–20 weight percent of an anionic detergent ingredient, and (c) between about 2–20 weight percent of a nonionic detergent ingredient; and (2) dry mixing the detergent blend granules with between about 0.7–5 weight percent of an ingredient consisting of particulate fatty acid salt selected from alkali metal and ammonium salts of stearic acid and oleic acid having an average particle size between about 50–200 microns, thereby forming an adherent coating of the fatty acid salt ingredient on the surfaces of the detergent blend granules.

* * * * *